US005816025A

United States Patent [19]

Nerli et al.

[11] Patent Number: 5,816,025

[45] Date of Patent: Oct. 6, 1998

[54] METHOD AND DEVICE FOR LEVELLING LONG SHAPED PASTA IN PACKING MACHINES

[75] Inventors: Riccardo Nerli, Massa e Cozzile; Paolo Vezzani, Capannori, both of Italy

[73] Assignee: Officine Meccaniche Stiavelli s.r.l., Uzzano, Italy

[21] Appl. No.: 837,345

[22] Filed: Apr. 17, 1997

[30] Foreign Application Priority Data

May 9, 1996 [IT] Italy ..... RM96A0320

[51] Int. Cl.[6] ..... B65B 63/02

[52] U.S. Cl. ..... 53/439; 53/446; 53/447; 53/529; 53/540; 53/544

[58] Field of Search ..... 53/439, 446, 447, 53/529, 540, 544

[56] References Cited

U.S. PATENT DOCUMENTS

| | | | |
|---|---|---|---|
| 3,932,983 | 1/1976 | Hughes | 53/252 |
| 4,054,019 | 10/1977 | Weichhand et al. | 53/252 X |
| 4,062,169 | 12/1977 | Lister et al. | 53/439 |
| 4,179,865 | 12/1979 | Pellaton | 53/473 X |
| 4,478,024 | 10/1984 | Vedvik et al. | 53/473 |
| 4,618,055 | 10/1986 | Porcelli | 198/422 |
| 4,635,786 | 1/1987 | Renda | 198/424 |
| 4,709,535 | 12/1987 | Mahaffy et al. | 53/473 |
| 4,769,975 | 9/1988 | Fava | 53/540 X |
| 5,018,338 | 5/1991 | Jurchuk et al. | 53/532 |
| 5,060,457 | 10/1991 | Zambelli | 53/543 |
| 5,184,711 | 2/1993 | Zambelli | 198/419.2 |
| 5,483,786 | 1/1996 | Giesbrecht et al. | 53/258 X |
| 5,682,734 | 11/1997 | Laster | 53/258 X |

*Primary Examiner*—Daniel Moon
*Attorney, Agent, or Firm*—Young & Thompson

[57] ABSTRACT

Levelling method realized by the simultaneous action of an abutment device and a retaining device for the product, rotating at variable speed in a periodic manner. The abutment device eliminates the end projections of the elements of the long shaped pasta, while the retaining device holds the single long shaped pasta elements firmly in their position, acting from above. The rotational speed varies during levelling, from a value equal to that of the transport collector for the product, so that the devices may be introduced in the collector, to a slowed down value, lasting for a longer time, where the soft contact between the levelling devices and the levelling product occurs.

20 Claims, 3 Drawing Sheets

METHOD AND DEVICE FOR LEVELLING LONG SHAPED PASTA IN PACKING MACHINES

BACKGROUND OF THE INVENTION

The present invention generally relates to machines and methods for distributing a predetermined amount and for packing or packaging long shaped pasta and more particularly, it relates to a levelling method for this product, before the packing thereof, in packing machines, and it relates further to a device to specifically carry out said method.

DESCRIPTION OF THE RELATED ART

According to the present state of the art, very different types of machines are known, for distributing a predetermined amount and for packing long shaped pasta.

In this case the only problem involving the levelling of this product will be emphasized, said product being fed by the system for distributing a predetermined amount thereof and being conveyed, after the levelling thereof, to the preliminary formation step of the packages.

In the application DE 93A000015, whose applicant is Pavan S.p.A., the levelling step is performed on a conveyor belt provided with lateral boards, which are separated from each other by a distance corresponding substantially to the length of the pasta; said lateral boards may be slightly tilted outwardly when the long shaped pasta to be packed is put therebetween.

During the forward movement of the conveyor belt, said lateral boards assume a vertical position, thereby levelling the amount of long shaped pasta contained on the conveyor belt, which is thereafter fed to the packing station.

This levelling method is employed in a machine for distributing and packing a predetermined amount of long shaped pasta, and involves an expensive apparatus (since it makes use of two feed channels, one for a coarse weighing and the other for the fine finish weighing) and is relatively slow; moreover, this method is intrinsically a levelling method which can work only when the advancement speed of the product is low, due to the high number of mechanical transitions performed in the unit of time on its movable parts.

The applicant has been producing a machine for distributing and packing a predetermined amount of long shaped pasta for a long time, said machine having a high performance with respect to the packing speed and packing quality. The levelling method comprises the step of introducing and temporary stopping the levelling blades or paddles, which are moved by a cam system, at the end of the displaced product, whereby the temporary stopping of the paddle or blade causes the abutment thereof against the product to be levelled.

Some problems occur only for very high operation speeds, because the fact that the levelling paddle or blade momentarily stops, implies a high difference in the instantaneous velocity between the translation of the moving collectors for the product, and the motion of the blade itself. The most usual problems are those related to the rebound effect of the elements forming the bundle of long shaped pasta, which tend to be disposed crosswise and to wedge themselves, leading to an imperfect levelling.

SUMMARY OF THE INVENTION

An object of the present invention is to provide a levelling method for long shaped pasta for machines distributing and packing a predetermined amount of said shaped pasta, and an apparatus to carry out said method, wherein it is possible to work with a high packing speed, maintaining at the same time a high levelling quality.

A further object of the present invention is to provide a levelling method for long shaped pasta, in machines for packing and distributing a predetermined amount of said shaped pasta, and an apparatus which realizes said method with a good tolerance, during the operation, when the transit speed of the product is high, and when the product is accidentally loaded beyond the predetermined quantity, or in any case with a volumetric value above the one specified by the weight of long shaped pasta to be packed.

Another object of the present invention is to provide a levelling method for long shaped pasta in machines for distributing a predetermined amount of said pasta and for packing it, and an apparatus carrying out this method and allowing to finely adjust the levelling according to the kind and the amount of the long shaped pasta subject to the levelling.

A last object of the present invention is to provide a levelling method for long shaped pasta in machines for distributing a predetermined amount and for packing these long shaped pastas, and to provide a device for carrying out said method, employing standard constitutive parts, materials and technologies in the field of mechanical design, so as to limit the cost of the apparatus and to facilitate its maintenance.

These and other objects which will result in the course of the description, are attained through a method wherein the levelling is performed by the simultaneous action of an abutment device of the product and of a retaining device of the product itself; these devices have a rotation motion which changes periodically. The first abutment device eliminates the end projections of the long shaped pasta elements projecting out of the bundle, while the retaining device retains from above the long shaped pasta elements, preventing their possible elastic bending or their separation from the bundle.

The angular velocity of the structures supporting the levelling assemblies changes so as to include a first phase of the period, in which both levelling assemblies slow down during their descent towards the transport collector of the product to be levelled, and a successive second phase, in which they are accelerated until they reach a speed equal to that of the transport collector of the product, so as to be introduced in the collector itself. During a third phase, there occurs a slowing down in an extended period of time with respect to the other two phases, in which there occurs the real levelling by means of the smooth contact between the abutment and retaining devices and the product to be levelled; a fourth final acceleration phase corresponds to the levelling assemblies leaving the transport collector of the product.

BRIEF DESCRIPTION OF THE DRAWINGS

A preferred embodiment of the invention will be described in the following only for illustrative purposes and without limitation of the general nature and possible applications thereof, referring to the drawings, wherein.

DESCRIPTION OF THE PREFERRED EMBODIMENTS

It must be stated beforehand that for clarity all figures are schematical representations so as to eliminate constructive features which are obviously present but which are irrelevant for the description of the preferred embodiment; moreover, in both sectional views the same numeral denotes the same component.

Figure 1:
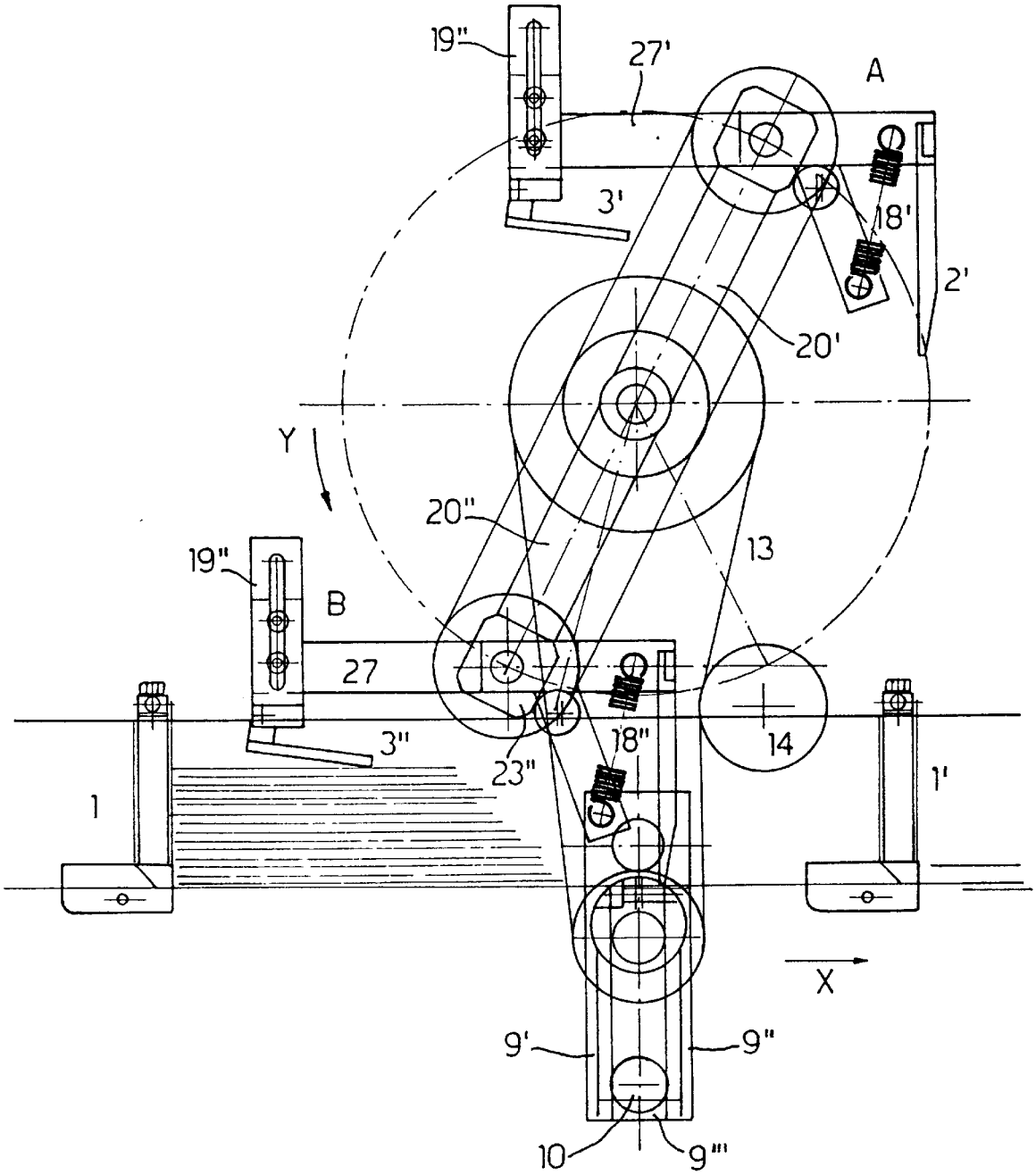
FIG. 1 is a transversal sectional view of the apparatus of the present invention.
Figure 2:
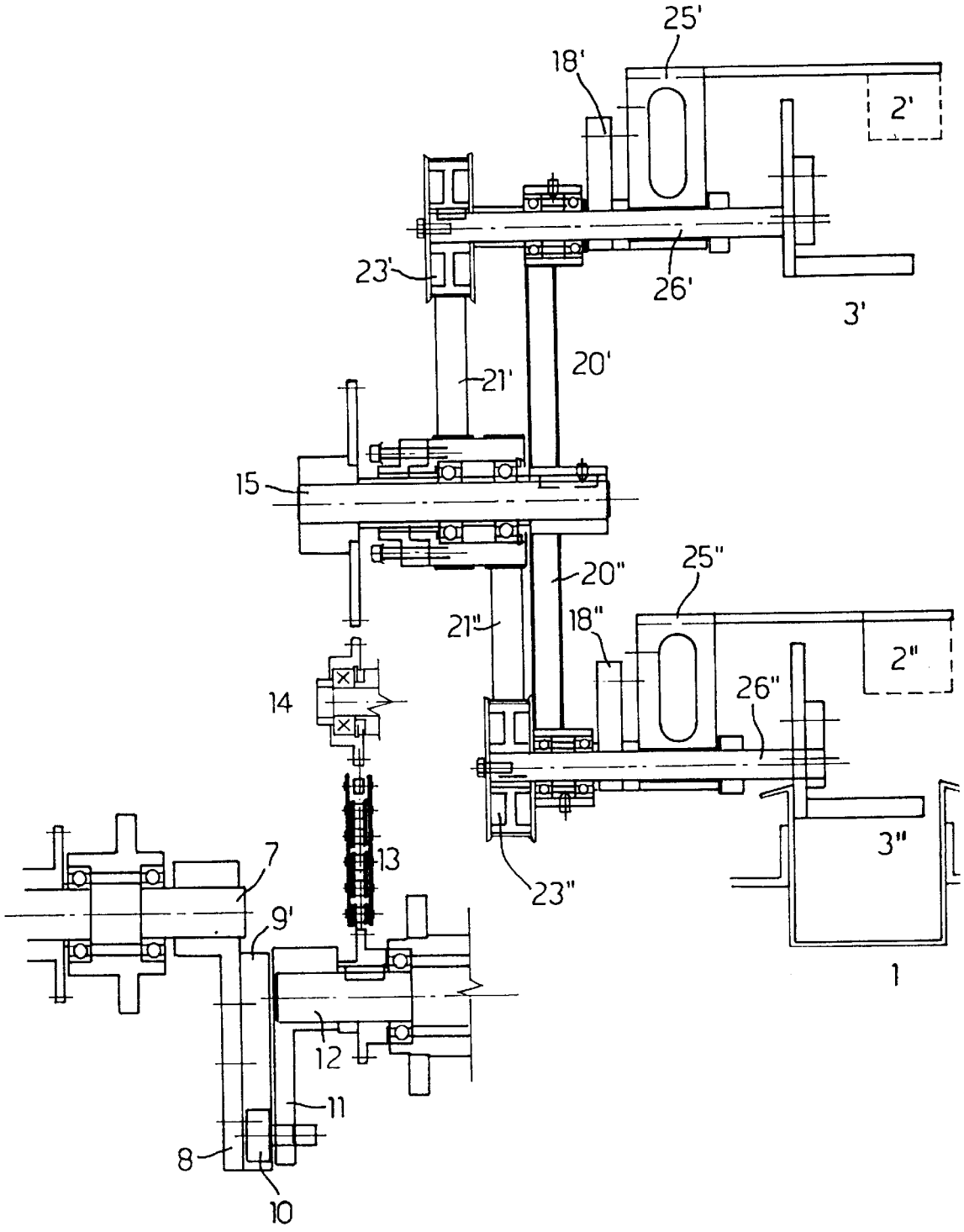
FIG. 2 is a front sectional view of the apparatus shown in FIG. 1.

In both sectional views of FIGS. 1, 2, the configuration of two levelling rotation arms A and B is put in evidence, said arms being supported by two supporting axes 20' and 20" and being rotated during the rotation with variable speed, by means of the corresponding pulleys 23' and 23", by two drive belts 21' and 21", arranged on two parallel spaced apart planes. Both levelling groups A and B include the abutment blades or paddles 2', 2" and the retaining blades or paddles 3', 3" of the product; there are also included safety elastic retainers 18' and 18" which are directly connected to the respective abutment paddle or blade 2', 2", and sliding supports 19', 19" allowing a fine adjustment of the level of the respective retainig blades or paddles 3',3" for the product.

The long shaped pasta to be levelled is already loaded in the collector 1, 1', as shown in FIG. 1, and said collector is moving in the direction of the arrow X towards the final shaping and packing station. FIG. 1 also shows the position assumed by the levelling device B, according to the invention, in the levelling condition of the "spaghetti" obtained by the blade 2', which during its rotational variable speed motion, has been introduced in the collector 1,1' for long shaped pasta, in a position between the long shaped pasta and the end 1' of the collector, said blade effecting the abutment or levelling operation, when the value of its variable velocity reaches its minimum, so that the uniform translational motion of the collector 1,1' causes the long shaped pasta to be levelled, into contact with the blade 2" in a slowed down movement. In this position of the levelling assembly B, the position of the blade 3" is such that said blade is brought into contact with the upper zone of the bundle of long shaped pasta, so as to retain it, preventing elastic bending and separation of the single elements of long shaped pasta and "guiding" them in the course of the settlement produced by the leading blade 2". This levelling operation which involves simultaneously an upper contact for retaining the product by the blade 3", and a further contact at the leading end of the long shaped pasta bundle with the abutment blade 2", occurs in a time interval in which the rotational motion of the rotating apparatus B supporting the paddles 2",3" is slowed down to a zero velocity, whereafter the speed is again increased at the same time when the levelling paddles or blades of the levelling assembly B leave the collector 1,1'.

Figure 3:
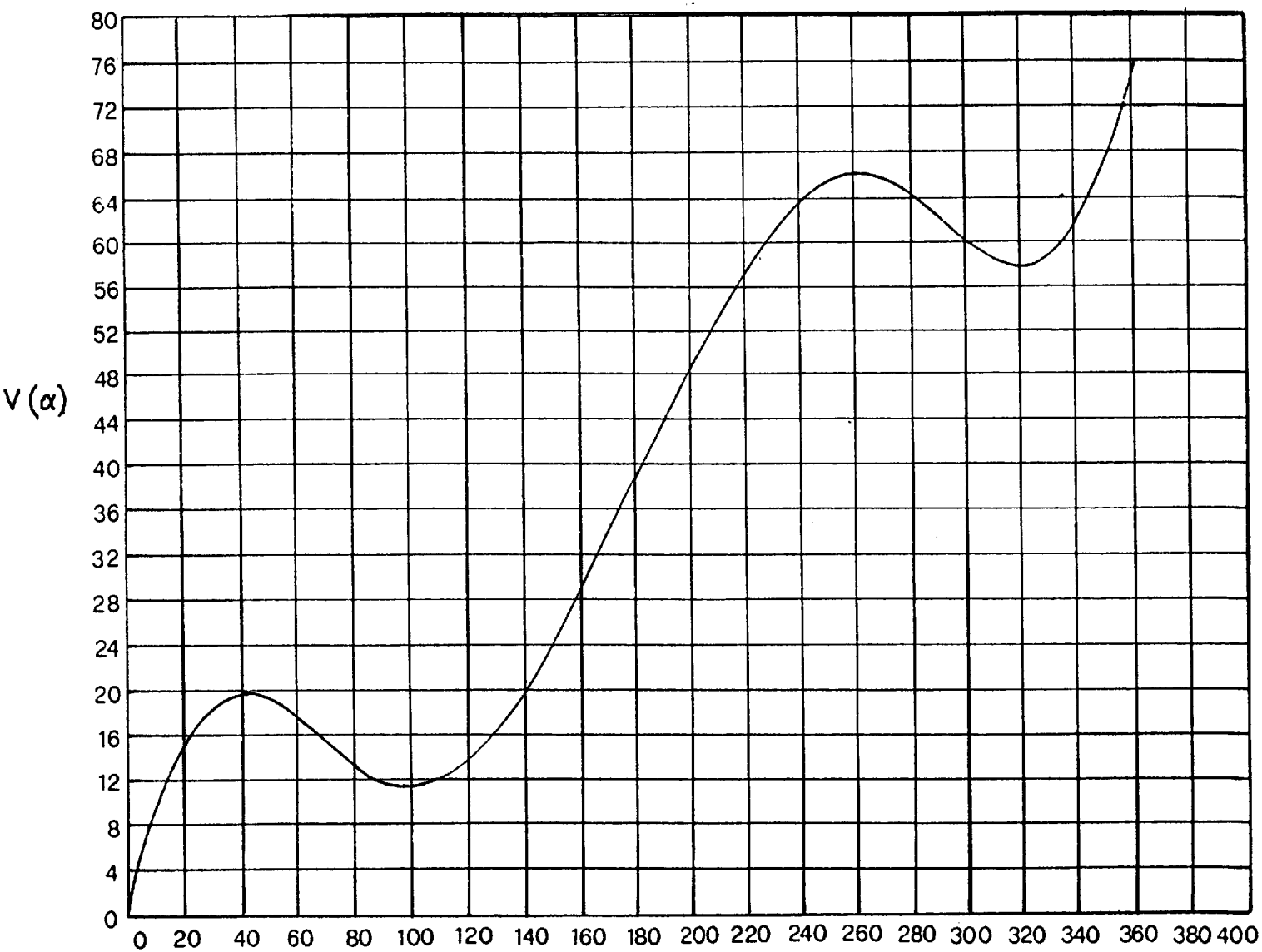
FIG. 3 is a plot illustrating the variation of the relative velocities in the course of the levelling operation.

FIG. 3 shows a qualitative plot of the velocity, wherein on the ordinate are written the values of the differential between the effective rotational displacement of the levelling assembly and the corresponding angle covered by the drive shaft 2, referring to the turn angle which is written on the abscissa. After a first phase comprised between 0° and 40°, in which the levelling assembly slows down, once the latter enters the transport collector of the product (between 40° and 100°), the velocity increases and this causes the paddles 2 and 3 into contact with the product to be levelled; thereafter, between 100° and 260° the speed decreases again, and this slowing down produces the real levelling, which therefore is obtained by a smooth contact; thereafter (beyond 260°) the velocity increases and the apparatus supporting the blades leaves the collector.

The two levelling assemblies A and B, rotating with periodically variable speed, define a parallelogram whose opposite sides formed by the axes 27', 27" are always horizontal and parallel to the advancement surface of the collectors 1', 1", . . . $\mathbf{1}^n$ of the product to be levelled.

In the following there will be described how, starting from a rotational motion with constant speed induced by a drive shaft 7, it is possible to obtain a rotational motion with a speed which varies periodically, such as to bring the two levelling assemblies A and B inside or outside of the collectors 1, 1', $\mathbf{1}^{n-1}$, . . . $\mathbf{1}^n$, thereby synchronizing the required levelling operations.

Between the drive shaft 7, which produces the rotational motion, and the levelling assemblies A and B, is interposed a plurality of crank mechanisms and coupling bearings allowing to transform the original rotational motion with constant angular velocity, into a rotational motion with variable angular velocity, producing the required phase differences.

The shaft 7 is rigidly connected to a crank mechanism 8 moving with a constant angular velocity, guides 9', 9" and 9'" made of ground hardened steel being connected by rivets on said crank mechanism and forming a slot of a predetermined length in which a bearing 10 with an idle pin can slide. The bearing 10 is connected to a crank mechanism 11, which, being connected both to the bearing and the shaft 12, transmits the movement to said shaft 12 and consequently to the chain 13 mounted around it, whereby the movement is converted into a rotational movement with periodically variable speed by the eccentricity due to the sliding of the bearing 10 with the idle pin, inside the guide crank 9 connected by rivets, whereby said chain, provided with appropriate interposed tensioners 14, transmits said rotational motion with periodically variable speed to the shaft 15 supporting the two levelling arms A and B. The speed variation of the crank mechanism 11, related to the increase or decrease of the distance between itself and the drive shaft 7, induced by the sliding movement of the bearing 10 with the idle pin inside the guide 9, allows ultimately, by an adequate choice of the dimensions of the components for transmitting the motion, to obtain the phase differences and synchronizations which are necessary for the abutment and retaining action to be performed simultaneously on long shaped pasta, required during levelling, with speeds which ensure a soft approach of the blades 2 and 3 towards the bundle of long shaped pasta, even if the velocity of the transport collectors for the product remains high.

A particular characterizing feature of the levelling assemblies A and B is given by the safety retaining system provided by the spring 18', 18" with the related anchor means. An end of each spring 18', 18" is fixed to the supporting structure 25', 25" of the blades or paddles 2', 2" which is pierced in FIG. 2 for reasons of balancing and weight and which can rotate with a certain play with respect to the supporting axis 26',26"; the other end of each spring 18',18" is fixed to the structure of the levelling assembly. This configuration allows an optimum operation for two fundamental reasons. First of all, the elasticity of the spring allows a certain springing and therefore a tolerance with respect to an amount of the product which exceeds the foreseen level and measures and which accidentally was loaded in the transport collectors 1',1", . . . $\mathbf{1}^{n-1}$,$\mathbf{1}^n$. Moreover, since when the blade 2 exerts a pressure on the long shaped pasta to be levelled it pulls the spring connected thereto, said spring allows the mutual contact between the blade of the levelling assembly and the product, to be prolonged along a path which is longer than the simple geometrical tangency limited to a single point, which can be deduced from the rotation path of the axes 20 and 21 with respect to the trajectory given by the translational motion of the product collectors 1',1".

A further important constructive detail concerns the structure of the retaining blades 31',3" which are arranged on height adjustable elements 19',19", allowing to lift or to lower the retaining blades, according to the amount and type of long shaped pasta to be levelled.

The device of the present invention allows to preserve all technical features which are already known in similar machines, for instance the introduction of a blade breaking an element of the long shaped pasta bundle which has assumed a transversal and tilted position. Such additional devices have not been shown for clarity of representation and because they are well known in the art.

The main advantage of the illustrated device is that it allows to obtain a high operation speed, preserving at the same time a good reliability and optimum performance with respect to the packing quality. The levelling technique according to the present invention can be applied to a machine for distributing a predetermined amount and for packing long shaped pasta, said machine having been tested for years on every kind of long shaped pasta and being of considerable operative simplicity.

We claim:

1. A method of levelling a long shaped pasta bundle having bundle elements projecting forward of said bundle and bundle elements laid transversely and tilted within said bundle, moving toward a packing station within a collector in a horizontal plane, with a packing machine utilizing an abutment device and a retaining device having periodically variable rotational motion in a vertical plane, comprising the steps of:

(a) during a first period, from an initial velocity and position above said pasta bundle, said abutment device and said retaining device descend toward said pasta bundle with a decelerating velocity;

(b) during a second period, as said abutment device and said retaining device near said pasta bundle, said abutment device and said retaining device accelerate to a speed equal to a speed of said pasta bundle;

(c) during a third period, said abutment device moves forward of said pasta bundle within said collector and said retaining device contacts a top of said pasta bundle within said collector, and said abutment device and said retaining device decelerate so that said bundle elements projecting forward contact said abutment device and move into said pasta bundle and said retaining device prevents said pasta bundle elements from either projecting out of said pasta bundle or being separated from said pasta bundle and guides said pasta bundle elements laid transversely and tilted within said bundle into a leveled bundle; and (d) during a fourth period, after said pasta bundle has been leveled into said leveled bundle, said abutment device and said retaining device accelerates away from said leveled bundle.

2. The method of claim 1, wherein during said third period, said abutment device and said retaining device simultaneously contact said pasta bundle.

3. The method of claim 1, wherein during said third period, said abutment device and said retaining device slow to a zero velocity.

4. The method of claim 3, wherein after said abutment device and said retaining device simultaneously slow to a zero velocity, said fourth period begins by said abutment device and said retaining device being moved away from said leveled bundle.

5. The method of claim 1, wherein said abutment device and said retaining device having said periodically variable rotational motion in said vertical plane describes 360° of rotational movement comprising 40° of movement during said first period, 60° of movement during said second period, 160° of movement during said third period, and 100° of movement during said fourth period.

6. A levelling device for levelling long shaped pasta bundles comprising:

first and second rotating levelling assemblies, said rotating levelling assemblies rotating in a first vertical plane and each said assembly comprising an abutment blade and a retaining blade for levelling said pasta bundles by contacting a forward face and a top respectively of said pasta bundle during horizontal movement of said pasta bundle;

first and second supporting axes supporting said first and second rotating levelling assemblies respectively about a central rotation point;

first and second driving belts arranged in a second and a third vertical plane respectively, and operatively connected to said first and second supporting axes respectively to rotate said rotating levelling assemblies; and a drive means for driving said first and second driving belts and causing said first and second rotating levelling assemblies to rotate with periodically variable rotational motion.

7. The levelling device of claim 6, further comprising:

a first crank mechanism;

a first shaft for rotating at a constant angular velocity and rigidly connected to said first crank mechanism to transmit a constant motion to said first crank mechanism;

a guide formed on said first crank mechanism for providing a sliding movement therein of a bearing with an idle pin;

a second crank mechanism connected to said bearing and integral with a second shaft operatively connected to said rotating levelling assemblies for transmitting a rotational motion with a periodically variable velocity to said rotating levelling assemblies.

8. The levelling device of claim 7, wherein said guide formed on said first crank mechanism for providing a sliding movement therein of a bearing with an idle pin is comprised on constitutive element made of ground hardened steel, said constitutive elements fixed together with rivets.

9. The levelling device of claim 6, wherein each of said levelling assemblies comprise:

a mounting structure attached, intermediate two ends of said mounting structure, to one end of one of said supporting axes acting as an assembly supporting axis;

a spring device connected to said mounting structure for retaining said abutment blade; and an adjustable support attached to an end of said mounting structure and to said retaining blade for adjusting a level of said retaining blade.

10. The levelling device of claim 9, wherein each of said rotating levelling assemblies further comprise:

a retaining system comprising a support structure connected at said one end of one of said supporting axes so that said support structure can rotate with respect to said assembly supporting axis and said spring device, said spring device further comprising a spring having a first end fixed to said support structure and a second end fixed to said mounting structure so that said abutment blade may elastically rotate about said assembly supporting axis.

11. The levelling device of claim 10, wherein said retaining system is dimensioned to accommodate said long shaped pasta bundles being of a variable size by the action of said spring allowing an elastic rotation of said abutment blade.

12. The levelling device of claim 10, wherein said abutment blade and said retaining blade of said rotating levelling assembly rotating in said first vertical plane levelling contacts said pasta bundle for an extended time period due to said elastic rotation so that the period of levelling is increased beyond that which would occur without benefit of said elastic rotation.

13. The levelling device of claim 6, wherein said first and second rotating levelling assemblies further comprise means for adjusting said retaining blade for said pasta bundles of varying heights.

14. The levelling device of claim 6, wherein said drive means is connected to a main drive system of a packing machine.

15. The levelling device of claim 6, wherein said drive means is powered from a dedicated drive.

16. The levelling device of claim 6, wherein said drive means converts a constant rotational motion to a periodically variable velocity.

17. A levelling device for levelling long shaped pasta bundles comprising a rotating levelling assembly rotating in a vertical plane with periodically variable rotational speed, said rotating assembly comprising an abutment blade and a retaining blade for cooperatively levelling said pasta bundles by contacting, during a portion of said vertical rotation, a forward face and a top respectively of said pasta bundle.

18. The levelling device of claim 17, further comprising a drive means enabling said periodically variable rotational speed to approach zero during contact of said retaining blade with said pasta bundle.

19. The levelling device of claim 17, further comprising pivoting means extending said portion of said vertical rotation in which said retaining blade contacts said pasta bundle.

20. The levelling device of claim 17, wherein said retaining blade and said abutment blade cooperatively align long shaped pasta elements laid transversely and tilted within said pasta bundle into a leveled pasta bundle.

* * * * *